United States Patent [19]

Brooks

[11] 4,144,104

[45] Mar. 13, 1979

[54] STABLE HEAT SHRINKABLE TERNARY β-BRASS ALLOYS CONTAINING ALUMINUM

[75] Inventor: Peter L. Brooks, Palo Alto, Calif.

[73] Assignee: Raychem Corporation, Menlo Park, Calif.

[21] Appl. No.: 783,041

[22] Filed: Mar. 30, 1977

Related U.S. Application Data

[63] Continuation of Ser. No. 668,041, Mar. 18, 1976, abandoned.

[51] Int. Cl.[2] ..... C22F 1/08

[52] U.S. Cl. ..... 148/11.5 R; 75/157.5; 148/11.5 C

[58] Field of Search ..... 148/2, 1.5 R, 11.5 C, 148/32, 32.5, 12.7 C, 160, 130, 131; 75/157.5

[56] References Cited

U.S. PATENT DOCUMENTS

| | | | |
|---|---|---|---|
| 3,783,037 | 1/1974 | Brook et al. | 148/11.5 C |
| 3,816,187 | 6/1974 | Smith | 148/11.5 C |
| 4,036,669 | 7/1977 | Brook et al. | 148/11.5 C |

OTHER PUBLICATIONS

Journal of the Institute of Metals, vol. 93, 1970, pp. 188-192.

Zeitschrift fur Metallkunde, 24, Heft. 1, Jan. 1932, pp. 1-6, Bauer & Hansen.

*Primary Examiner*—L. Dewayne Rutledge
*Assistant Examiner*—Peter K. Skiff
*Attorney, Agent, or Firm*—Lyon & Lyon

[57] ABSTRACT

Those alloys falling within the area on a ternary diagram defined by the points:

| | | | |
|---|---|---|---|
| A. | 78.3% Cu | 9.7% Al | 12% Zn |
| B. | 75.1% Cu | 7.5% Al | 17.4% Zn |
| C. | 67% Cu | 4.2% Al | 28.8% Zn |
| D. | 72.6% Cu | 7.9% Al | 19.5% Zn |

are particularly suited for use as the material of heat recoverable articles as they exhibit good ductility and stability and are easily worked by hot working techniques. Additionally, they have $M_3$ temperatures which enables them to be fabricated into heat recoverable articles useful in many applications.

A heat recoverable article, made from a ternary alloy of copper, aluminum, and zinc whose composition falls on or near the eutectoid line, is particularly suited for use in circumstances where the article has been recovered from its recoverable state under conditions such that a degree of unresolved recovery remains.

6 Claims, 2 Drawing Figures

TRACE OF EUTECTOID
WEIGHT % ZINC
WEIGHT % ALUMINUM
50
45
40
35
30
25
20
15
10
5
0
5
10
15
MS
-200c
-125c
-50c
+25c

STABLE HEAT SHRINKABLE TERNARY β-BRASS ALLOYS CONTAINING ALUMINUM

This is a continuation of application Ser. No. 668,041, filed Mar. 18, 1976, abandoned.

FIELD OF THE INVENTION

This invention relates to metal alloys capable of being rendered heat recoverable. In another aspect, it relates to heat recoverable metal articles.

CROSS-REFERENCE TO RELATED APPLICATIONS

This application is related to, and incorporates by reference, my concurrently filed applications, "Stable Heat Recoverable Ternary β-Brass Type Alloys Containing Manganese" having Ser. No. 668,028, now abandoned and "Heat Recoverable Quarternary β-Brass Type Alloys" having Ser. No. 668,040, now abandoned.

BACKGROUND OF THE INVENTION

Materials, both organic and metallic, capable of being rendered heat recoverable are well known. An article made from such materials can be deformed from an original, heat-stable configuration to a second, heat-unstable configuration. The article is said to be heat recoverable for the reason that, upon the application of heat, it can be caused to revert from its heat-unstable configuration to its original, heat-stable configuration.

Among metals, for example certain alloys of titanium and nickel, the ability to be rendered heat recoverable is a result of the fact that the metal undergoes a reversible transformation from an austenitic state to a martensitic state with changes in temperature. An article made from such a metal, for example a hollow sleeve, is easily deformed from its original configuration to a new configuration when cooled below the temperature at which the metal is transformed from the austenitic state to the martensitic state. This temperature, or temperature range, is usually referred to as the $M_s$ temperature. When an article thus deformed is warmed to the temperature at which the metal reverts back to austenite, referred to as the $A_s$ temperature or range, the deformed object will revert to its original configuration. Thus, when the hollow sleeve referred to above is cooled to a temperature at which the metal becomes martensitic, it can be easily expanded to a larger diameter, for example, by using a mandrel. If the expanded sleeve is subsequently allowed to warm to the temperature at which the metal reverts back to its austenitic state, the sleeve will revert to its original dimensions.

Ordinarily, such a sleeve would recover all or substantially all of the deformation, i.e., it would revert completely to its original dimensions. However, it should be noted that under certain circumstances the article might be deformed to such an extent that all of the deformation cannot be recovered on heating. Alternatively, if something, e.g., an intervening rigid substrate having a greater external dimension than the internal pre-deformation dimensions of the sleeve is interposed within the sleeve, the sleeve cannot recover to its original dimensions. Any dimensional change up to the maximum available which an article can recover absent any intervening substrate is called the heat recoverable strain. That portion of the heat recoverable strain which an intervening substrate or other agency precludes recovery of, is referred to as unresolved recovery. Finally, any deformation which exceeds the maximum available heat recoverable strain is said to effect non-recoverable strain.

That the titanium nickel alloys referred to above possess the property of heat recoverability has been known for many years. More recently, Brook et al, for example in U.S. Pat. No. 3,783,037, the disclosure of which is incorporated by reference, have disclosed a method for producing a heat recoverably article in which an alloy comprising an inter-metallic compound that undergoes a diffusionless transformation into a banded martensite upon cooling with or without working is deformed after appropriate heat treatment. On reheating the article, it at least partly resumes its original shape. The alloys preferred by Brook et al. are copper based alloys which transform into a martensite of pseudo-cubic symmetry. The preferred alloys include the binary copper-zinc and copper-aluminum systems and the ternary copper-aluminum-zinc, copper-alluminum-tin, copper-zinc-silicon, copper-aluminum-manganese, copper-aluminum-iron and copper-aluminum-nickel systems.

In U.S. Pat. No. 3,783,037 (Col. 8, ln. 63 et seq.) Brook et al. note in respect to the copper-aluminum-zinc system that ". . . as there is progressive increase in the aluminum content and decrease in the zinc content . . . the maximum ductility that can be produced in the ternary alloys when deformed at or near the $M_s$ decreases." They further note that as the aluminum level increases, the maximum obtainable heat recoverable strain decreases. For example, in alloys of the compositions (by weight) 72% copper, 22% zinc and 6% aluminum and 75.7% copper, 17% zinc and 7.5% aluminum, the maximum heat recoverable strain was reported to be 4.8% and 4.0%, respectively.

The clear teaching of this patent is therefore that the aluminum content of the alloy should be reduced as much as possible to achieve enhanced heat recoverable strain. Unfortunately, I have found that, unknown to the prior art, reducing the aluminum content has a severe adverse effect on the stability of the article under conditions of unresolved recovery. Additionally, if one follows the teaching of the prior art and avoids ternary alloys containing significant quantities of aluminum, limitations are encountered in hot working. In particular, low energy input hot working requires avoidance of a second phase in the structure. Unfortunately, low aluminum content alloys must be maintained at very high temperatures, e.g., at least in excess of 650° C., to be in the one-phase beta condition. At such high temperatures, tool life is shortened and the avoidance of coarse grain size in the product is very difficult.

If a heat recoverable article is recovered onto a substrate such that the substrate prevents full recovery of the article to its original configuration, i.e., under conditions of unresolved recovery, then the residual strain results in a stress in the article. I have now discovered that all copper alloy compositions having the β-brass structure are more or less unstable if complete recovery is prevented. Thus, I find that at moderate temperatures such as would typically be seen during service, for example, in hydraulic or electrical applications in aircraft, the residual stress in incompletely recovered articles will decay steadily to zero such that after a certain period of time the recovered object, for example, a sleeve recovered about a substrate, can be easily removed from the substrate.

Inasmuch as heat recoverable metals find their greatest utility in applications where they exert a high degree of compressive or other form of stress, it will be readily recognized by those skilled in the art that the stress relaxation process described above is a considerable impedement to the wide spread use of these metals. For example, parts made from the binary alloys and the specific ternary alloys described in the Brook et al patent mentioned above, when prevented from recovering completely to an initial configuration under conditions of about 4.0% unresolved recovery, exhibit complete stress relaxation at 125° C. in less than 1,000 hours (equivalent to within 100 hours at 150° C. ) so that they are essentially useless in many applications.

In the aformentioned patent, Brook et al also describe a process they term "reversible heat recoverable strain" in a copper-zinc-tin alloy which had an $M_s$ of −70° C. A sample of this alloy was quenched from 800° C., deformed below its $M_s$ and allowed to recover by heating above its $A_s$. It was noted that there was partial recovery of the strain that had been induced in the alloy by its deformation as it was heated into the range in which the alloy reverted to its austenitic state. On further heating to 250° C., the specimen suprisingly changed shape by immediately moving back toward the deformed configuration. This alloy was considered by them to be unique in this regard. I have found that this phenomenon of reverse recovery is by no means unique to the particular alloy reported but is, in fact, prevalent among many of the reported prior art compositions. Such phenomenon is merely a particularly severe manifestation of the unresolved recovery induced instability (stress relaxation) hereinafter discussed in greater detail, i.e., a loss of stress even under zero restraining force. Needless to say, none of my instantly claimed alloys manifest such a phenomenon.

Therefore, although a wide variety of β-brass type copper alloy compositions capable of being rendered heat recoverable are known to the prior art, those compositions possess serious shortcomings severely limiting their use.

Accordingly, one object of this invention is to provide improved β-brass type alloys.

Another object of this invention is to provide heat recoverable articles of β-brass type alloys that will exhibit long term stress stability when recovered under conditions so that a level of unresolved recovery remains.

Yet another object of this invention is to provide heat recoverable articles of β-brass type alloys that will maintain a stress for greater than 1,000 hours at 125° C. or for greater than 100 hours at 150° C.

SUMMARY OF THE INVENTION

According to the present invention there is provided ternary alloys of copper, aluminum and zinc whose composition fall on or near the line formed by the binary copper-aluminum beta →(alpha + gamma) eutectoid as it crosses the ternary field to join the binary copper-zinc eutectoid. This will be referred to hereinafter as the eutectoid line.

Heat recoverable articles made from these alloys exhibit long term stress stability even when recovered under circumstances that a level of unresolved recovery remains.

The alloys of the present invention fall within the area defined in a ternary diagram by the points:

| | | | |
|---|---|---|---|
| A. | 78.3% Cu | 9.7% Al | 12% Zn |

-continued

| | | | |
|---|---|---|---|
| B. | 75.1% Cu | 7.5% Al | 17.4% Zn |
| C. | 67% Cu | 4.2% Al | 28.8% Zn |
| D. | 72.6% Cu | 7.9% Al | 19.5% Zn |

such alloys not only exhibit long term stress stability but also manifest good ductility and are easily worked by hot working techniques. Both good ductility and hot workability are requiste for commercially useful materials.

BRIEF DESCRIPTION OF THE DRAWINGS

The FIG. I is a ternary diagram on which is shown the area encompassing the preferred alloy of the present invention, wherein line XY is the eutectoid line.

FIG. II is a ternary diagram for alloys of copper, aluminum and zinc showing the coincidence of the eutectoid line XY and $M_s$. Copper is not specifically shown but, of course, copper + aluminum + zinc = 100%. The alloys in question were quenched from 650° C. into water at 20° C.

DETAILED DESCRIPTION OF THE INVENTION

Figure 1:
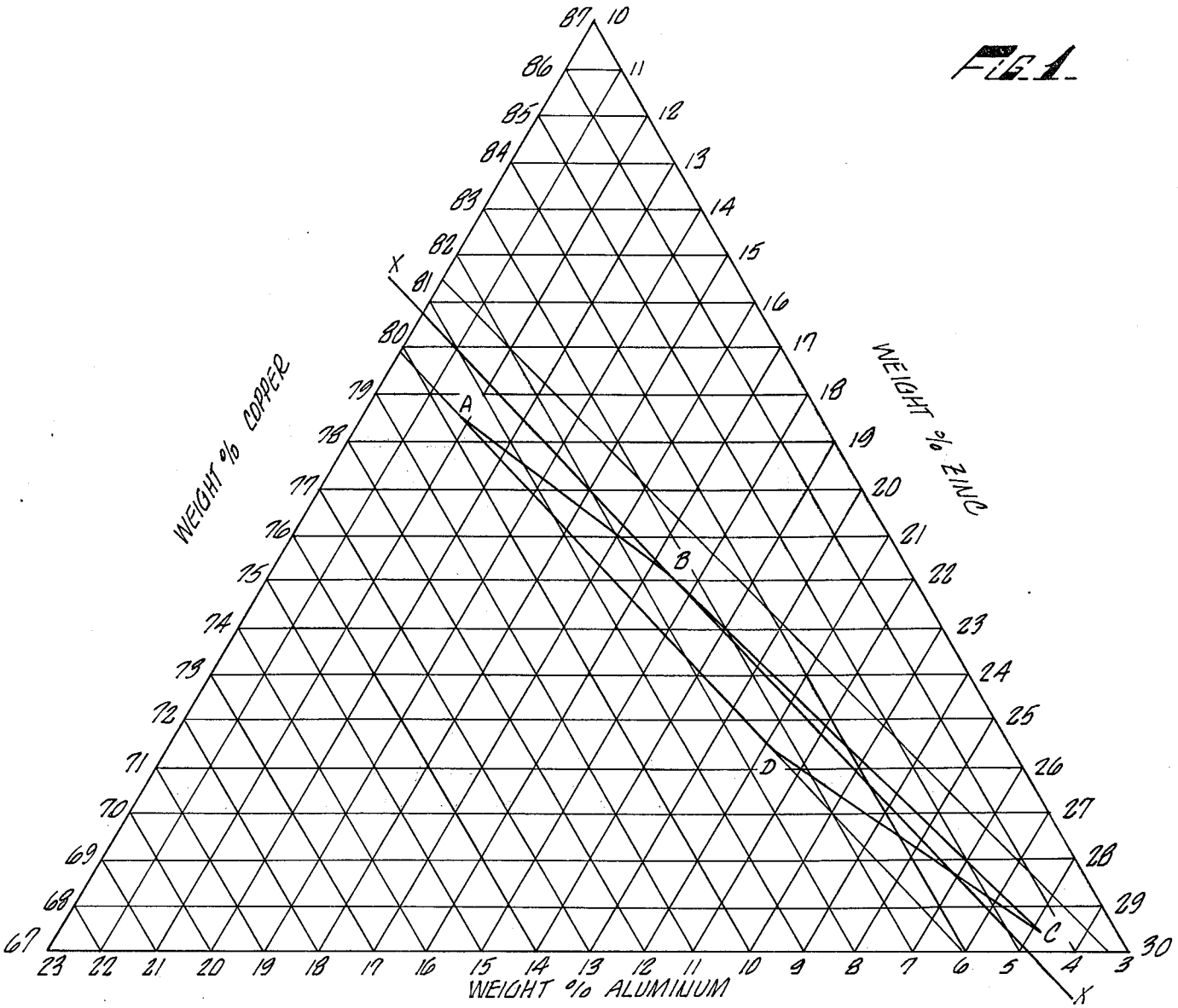
Figure 2:
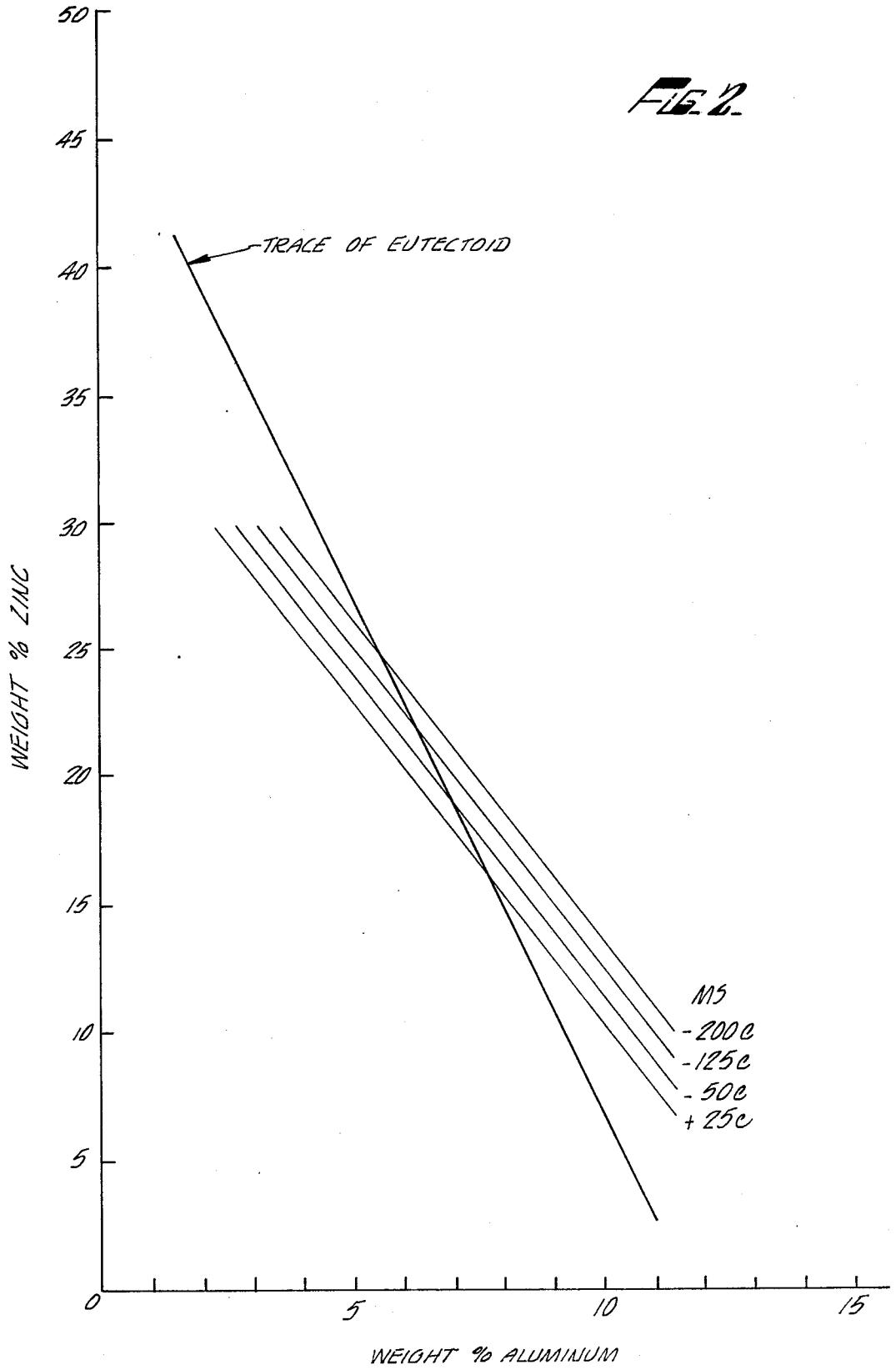

As previously discussed in the Background of the Invention, I have unexpectedly discovered that articles formed from the β-brass type compositions known to the prior art suffer the serious disadvantage of being unstable with respect to the maintenance of stress when the article has been exposed to modestly elevated temperatures for extended periods of time under conditions of unresolved recovery. This phenomenon manifests itself in actual use situations when an article made from such an alloy is deformed when in its martensitic state to thereby render it heat recoverable and then allowed to recover by warming it to a temperature at which the alloy reverts to austenite in a manner that precludes the article from completely recovering to its original configuration and thereafter exposed to temperatures above about 80° C. That portion of the strain which remains in the article after this partial recovery is, as above indicated, referred to as unresolved recovery.

I have discovered that, surprisingly, the tendency of alloys to fail in the manner described above is composition dependent and that those alloys of copper, aluminum and zinc whose compositions lie within that portion of a ternary diagram defined by the points:

| | | | |
|---|---|---|---|
| A. | 78.3% Cu | 9.7% Al | 12% Zn |
| B. | 75.1% Cu | 7.5% Al | 17.4% Zn |
| C. | 67% Cu | 4.2% Al | 28.8% Zn |
| D. | 72.6% Cu | 7.9% Al | 19.5% Zn |

exhibit superior stability in comparison with all other heat recoverable alloys of the same elements. In particular, it is only those alloys falling within the above indicated area that do not undergo complete stress relaxation over a period of 1,000 hours or less at 125° C. (or the equivalent 100 hours at 150° C.). I have further discovered that the novel alloys which are the subject of the instant invention all have a composition falling on or near the eutectoid line, as defined herein above.

Referring now to the FIG. II, there is shown a ternary diagram for alloys of copper, aluminum and zinc on which XY is the eutectoid line for alloys of those elements. For these alloys, there is only one composition on the eutectoid line, the line of maximum stress stability, for any given $M_s$ temperature. For example, the alloy having an $M_s$ of − 50° C. contains about 7% aluminum.

By adjusting the relative amounts of the individual components, other alloys of the same $M_s$ temperature can be obtained. Usually, however, significant variance from the eutectoid will cause some diminution in desirable properties. For example, increasing the aluminum content to 10% and adjusting the amounts of copper and zinc to achieve an $M_s$ of −50° C. results in moving the alloy to the gamma side of the eutectoid. Little stability is lost in this instance as increasing aluminum content offsets the effect on stability of moving away from the eutectoid line. However, use of such an alloy requires great care if precipitation of the gamma phase is to be avoided during fabricating and heat treatment. Also, the temperature to which the alloy must be raised during working to prevent gamma precipitation may lead to undesirable grain growth which adversely affects ductility.

By contrast, if the aluminum level is lowered so that the alloy falls on the alpha side of the eutectoid, working is easier. However, the stress stability of the alloy is reduced because of the cummulative effect of (1) moving away from the eutectoid and (2) decreasing the aluminum level. Thus, the desirable effect of increasing the alpha content in the alloy to allow easier working for those applications in which articles must be made by cold working must be weight against the loss of stress stability.

Ternary alloys of copper, aluminum and zinc are, of course, not novel in general. Furthermore, it is known (e.g., Brook et al. U.S. Pat. No. 3,783,037) that certain ternary alloys of copper, aluminum and zinc can be rendered heat recoverable. However, all the alloys specifically reported by the prior art fall outside the composition range of the instantly claimed alloys and hence suffer from fundamental shortcomings (including stability as heretofore discussed) which precludes their use under most circumstances. A consideration of the boundary lines of the claim compositional area indicates why the instantly claimed alloys are uniquely superior. These boundary parameters were, of course, unknown to the prior art. Additionally, the location of the eutectoid line and its significance to alloy stability were completely unknown to the prior art.

The claimed alloys are defined by the area encompassed by the lines AB, BC, CD, DA. Lines AB and CD are the 0° and −200° C. $M_s$ lines, respectively. An alloy with an $M_s$ of less than about −200° C. has limited use since it is impractical to store deformed components at lower temperatures. As is known, heat recoverable metallic articles, e.g., couplings are stored in the deformed conditions e.g., in liquid nitrogen and recover on warming or being warmed through their $M_s$. Conversely, an $M_s$ in excess of 0° C. is incompatible with a stability of at least 1,000 hours at 125° C. which is equivalent to 100 hours at 150° C. Stability of at least 1,000 hours at 125° C. is a requirement of electrical connectors under M/L Spec. MIL-C-23353A Paragraph 4.7.14. Compositions to the left of line DA must be heated to temperatures in excess of 650° C. to preclude formation of the γ-phase of the alloy. As heretofore indicated presence of γ-phase results in an alloy of such limited ductility as to effectively preclude its being cold formed into useful articles. Conversely, heating above 650° C. is undesireable because it fosters excessive grain growth, again affording poor ductility. Finally, alloys of a composition to the right of line BC likewise cannot meet the 1000° hours at 125° C. stability requirements.

It is thus apparent that only those alloys falling within the composition range defined by the perimeter AB, BC, CD, DA possess the unique combination of heat recoverability, a useful recovery temperature ($M_s$), worthwhile ductility, and adequate stability.

As can be seen on FIG. I, I have found that the eutectoid line runs through the claimed area. Alloys of a composition falling on or almost on this line are of particularly good stability. As used in the instant specification and the appended Claims, the term "eutectoidal composition" connotes an alloy whose composition falls either precisely on the eutectoid line or wherein none of the three metal components of the alloy is present in an amount which differs by more than 1.0 wt. % from the percentage of that metal present in the composition corresponding precisely to the eutectoid. It should, of course, be noted that in all instances only compositions falling within the above defined area ABCD are contemplated by the instant invention and that in some instances compositions wherein there is less than 1.0% variation of one or more of the metals from the precise eutectoid composition will fall outside such area. Inasmuch as the boundary lines of the claimed area represent other critical parameters, such compositions, even though eutectoidal, have other shortcomings and are not within the scope of the present invention.

The following are examples of alloys according to the present invention having a long term stress stability at 125° C. for at least 1000 hours or at least 100 hours at 150° C. Each alloy was quenched into water at 20° C. from 650° C. A 3" long sample was cooled to below the $M_s$ temperature for the alloy and deformed 4.25% by being bent into a U shape about a rod. The sample was heated to either 125° C. or 150° C. while being held in the deformed shape. Periodically the specimen was cooled to room temperature where the constraint was removed. When this was done, the amount of springback, i.e. movement toward the original configuration was measured. The specimen was then replaced in the constraint and held for a further period of time at either 125° C. or 150° C. When upon removal of the constraint no springback was observed, the time that it took to reach that condition was taken as the stability limit.

| | Alloy Composition | | | | |
|---|---|---|---|---|---|
| Sample | Cu | Al | Zn | $M_s$ | Lifetime at 150° C. |
| 1 | 75.5 | 7.5 | 17 | +27° C | 15 hours |
| 2 | 72 | 6 | 22 | −60° C | 65 hours |
| 3 | 71 | 6 | 23 | −127° C | 210 hours |
| 4 | 70 | 6 | 24 | −196° C | 270 hours |
| 5 | 74 | 7 | 19 | −28° C | 120 hours |
| 6 | 77 | 8 | 15 | +86° C | 15 hours |
| 7 | 69 | 5 | 26 | −156° C | 250 hours |

As is apparent, examples 1, 2, and 6, are directed towards compositions outside the scope of this invention.

I claim:

1. A ternary alloy comprised of copper, aluminum and zinc having a β-brass type structure falling within the area on a ternary diagram defined by the points:

| | | | |
|---|---|---|---|
| A. | 78.3% Cu | 9.7% Al | 12% Zn |
| B. | 75.1% Cu | 7.5% Al | 17.4% Zn |
| C. | 67% Cu | 4.2% Al | 28.8% Zn |

-continued

| | | | |
|---|---|---|---|
| D. | 72.6% Cu | 7.9% Al | 19.5% Zn |

said alloy being in its martensitic state and an $M_s$ temperature of 0° C. or lower and having been deformed from an original configuration to render it heat recoverable, said alloy exhibiting stress stability of at least 1,000 hrs at 125°° C. when caused to recover by being warmed to a temperature at which the alloy exists in its austenitic state so that a degree of unresolved recovery remains.

2. An alloy in accordance with claim 1 wherein said alloy has an eutectoidal composition, said eutectoidal composition being a composition wherein no metal of the group consisting of copper, aluminum and zinc is present in said alloy in an amount that differs by more than 1% by weight from the amount of said metal present in a composition corresponding to a eutectoidal composition defined by the line XY of the ternary diagram of FIG. 1.

3. An alloy in accordance with claim 2 wherein said alloy has an eutectoid composition.

4. A process for making a heat recoverable article that exhibits stress stability of at least 1,000 hours at 125° C. when allowed to recover so that a degree of unresolved recovery remains comprising the steps:

(a) selecting a ternary alloy capable of being rendered heat recoverable comprised of copper, aluminum and zinc having a $\beta$-brass type structure and having an $M_s$ temperature of 0° C. or lower falling within the area on a ternary diagram defined by the points:

| | | | |
|---|---|---|---|
| A. | 78.3% Cu | 9.7% Al | 12% Zn |
| B. | 75.1% Cu | 7.5% Al | 17.4% Zn |
| C. | 67% Cu | 4.2% Al | 28.8% Zn |
| D. | 72.6% Cu | 7.9% Al | 19.5% Zn |

(b) fabricating said article from the selected alloy into an original, heat-stable configuration, (c) cooling said article to a temperature at which the alloy exists in its martensitic state, and (d) deforming said article to a second, heat-unstable configuration from which recovery occurs when said article is warmed to a temperature at which the alloy reverts to austenite from said martensitic state.

5. A process according to claim 4 wherein said alloy has an eutectoidal composition, said eutectoidal composition being a composition wherein no metal of the group consisting of copper, aluminum and zinc is present in an amount that differs by more than 1% by weight from the amount of said metal in a composition corresponding to an eutectoid composition defined by the line XY of FIG. 1.

6. A process according to claim 5 wherein said alloy has an eutectoid composition.

* * * * *